United States Patent [19]

Jaconette

[11] 4,451,100

[45] May 29, 1984

[54] GROUNDING LATCH APPARATUS FOR ELECTRICAL CONNECTORS

[75] Inventor: Frank C. Jaconette, Trumbull, Conn.

[73] Assignee: Harvey Hubbell Incorporated, Orange, Conn.

[21] Appl. No.: 318,378

[22] Filed: Nov. 5, 1981

[51] Int. Cl.[3] ..... H01R 4/66

[52] U.S. Cl. ..... 339/14 R; 339/91 R; 339/74 R

[58] Field of Search ..... 339/14 R, 14 P, 91 R, 339/74 R

[56] References Cited

U.S. PATENT DOCUMENTS

| | | | |
|---|---|---|---|
| 2,000,318 | 5/1935 | Cannon | 173/328 |
| 2,420,866 | 5/1947 | Coss | 285/174 |
| 2,516,907 | 8/1950 | Penfold | 235/174 |
| 3,408,614 | 10/1968 | Kuwahata | 339/91 |
| 3,566,336 | 2/1971 | Johnson et al. | 339/91 |
| 3,639,950 | 2/1972 | Lutz et al. | 24/230 |
| 3,721,939 | 3/1973 | Paugh | 339/14 |
| 3,842,388 | 10/1974 | Harwood et al. | 339/59 |
| 4,027,096 | 5/1977 | Waddington et al. | 339/74 R |
| 4,029,378 | 6/1977 | Bolis | 339/22 |
| 4,113,179 | 9/1978 | McKee | 339/91 |
| 4,120,553 | 10/1978 | Muz | 339/91 |
| 4,146,287 | 3/1979 | Jonsson | 339/75 |
| 4,203,643 | 5/1980 | Krolak et al. | 339/107 |
| 4,245,879 | 1/1981 | Buck | 339/91 |
| 4,261,628 | 4/1981 | Gallagher et al. | 339/14 |
| 4,265,503 | 5/1981 | Baur | 339/45 |
| 4,272,145 | 6/1981 | LaDuke | 339/91 |

FOREIGN PATENT DOCUMENTS

| | | |
|---|---|---|
| 1238587 | 8/1969 | United Kingdom . |
| 1257687 | 12/1969 | United Kingdom . |
| 1600394 | 5/1977 | United Kingdom . |
| 2061633 | 10/1980 | United Kingdom . |

*Primary Examiner*—Eugene F. Desmond
*Assistant Examiner*—David L. Pirlot
*Attorney, Agent, or Firm*—Jerry M. Presson

[57] ABSTRACT

A latching apparatus for coupling together two mating connector housings includes a toothed latch member supported on a spring arm which is attached to a first one of the housings. The latch member includes a transverse surface formed with one or more teeth. The second housing carries a release member having a spring portion, a manually operable portion and openings to receive the teeth. When the housings are joined, the latch member enters the second housing such that the transverse surface overlies a spring extension of the manually operable member. Movement thereof extracts the teeth from the openings to release the housings. The latching apparatus forms a ground between the connectors.

4 Claims, 13 Drawing Figures

GROUNDING LATCH APPARATUS FOR ELECTRICAL CONNECTORS

This invention relates to an improved latching mechanism for releasably locking together the mating housings of an electrical connector wherein the latching mechanism forms a ground between the connectors.

BACKGROUND OF THE INVENTION

Various connectors are known in the prior art with latching mechanisms including some which are capable of completing a ground circuit between housings or between grounding elements in the connectors. Examples of these are found in the following references. U.S. Pat. Nos.

2,000,318, Cannon
2,420,866, Coss
2,516,907, Penfolo
3,408,614, Kuwahata
3,566,336, Johnson et al
3,639,950, Lutz et al
3,721,939, Paugh
3,842,388, Harwood et al
4,029,378, Bolis
4,113,179, McKee
4,120,553, Muz
4,146,287, Jonsson
4,203,643, Krolak et al
4,265,503, Baur
4,245,879, Buck
4,261,628, Gallagher et al
4,272,145, LaDuke However, these have various disadvantages including exposure of the latch element outside of the connector housings, thereby subjecting them to possible damage, or difficulty or unreliability of operation. Further, the latches generally complete the ground circuit only after the other connector elements have made contact with each other which presents the possibility of a potential existing on one of the housings, especially when the housing is metallic.

BRIEF DESCRIPTION OF THE INVENTION

Accordingly, an object of the invention is to provide a latch mechanism for latching two housings together wherein a latching member is provided on one of the housings and a manually operable release member is provided on the other housing.

A further object is to provide such an apparatus wherein the housing carrying the release member is largely electrically conductive and the latching member and release member are also electrically conductive so that the latch mechanism provides a ground circuit between the conductive housing and a ground circuit in the other housing.

Yet another object is to provide such an apparatus wherein the latching and release members are constructed so that the ground connection between the members is established as the housings are coupled together before the other electrical connector portions thereof make contact, and the ground connection is maintained as the housings are separated until the contact between the other connector portions is broken.

Briefly described, the invention includes a latching apparatus for an electrical connector assembly of the type including first and second telescopically joinable housings, each housing having an open end and containing electrically conductive members exposed to the open end thereof for making contact when the housings are joined in a predetermined relative orientation, and each housing carrying a portion of the latching apparatus which comprises a latch member having an outwardly extending tooth, means defining a lateral surface extending perpendicular to said tooth near the inner limit thereof, and a spring arm connected at one end to said means defining said surface and at the other end to a first one of said housings, means in a wall of the second one of said housings defining a first opening positioned to receive said tooth portion when said housings are joined, said tooth portion being urged into said opening by said spring arm, a manually operable release mechanism on said second one of said housing comprising a leaf spring extending parallel with said wall and adjacent said first opening, at least one end of said leaf spring being fixedly attached to said second housing, said leaf spring being positioned to extend in generally parallel relationship with said surface when said housings are joined, and means defining an access opening in said wall through which said leaf spring can be manually urged away from said wall to engage and move said surface, thereby disengaging said tooth portion from said first opening to permit separation of said housings.

In order that the manner in which the foregoing and other objects are attained in accordance with the invention can be understood in detail, particularly advantageous embodiments thereof will be described with reference to the accompanying drawings, which form a part of this specification and wherein.

Figure 1:
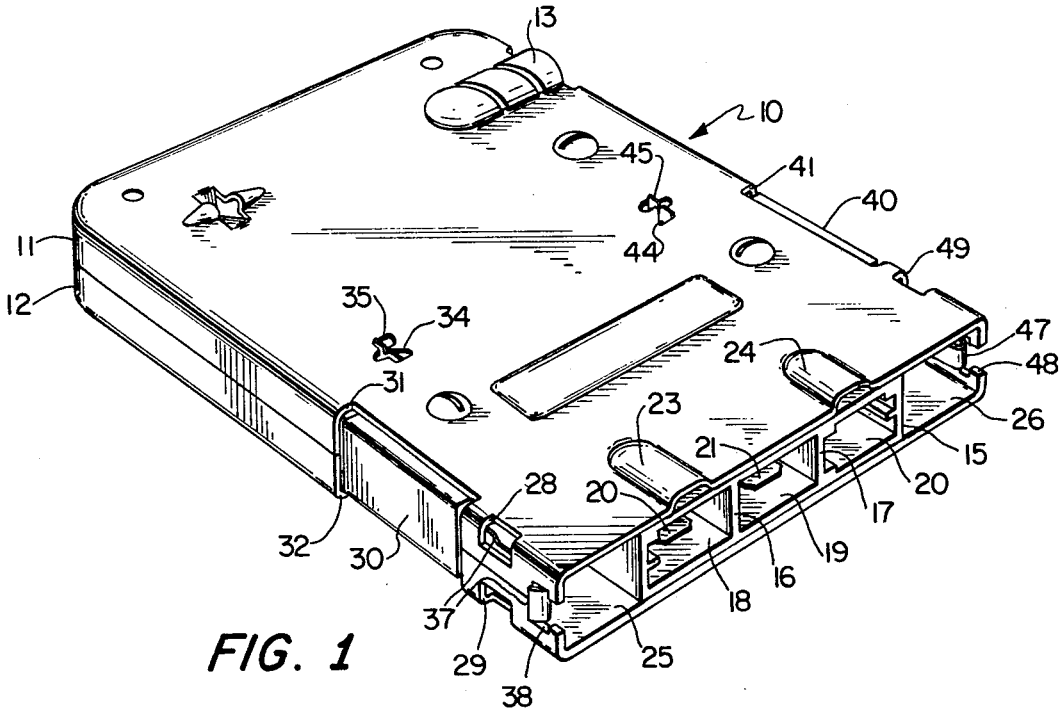
FIG. 1 is a perspective view of a plug portion of a connector incorporating the apparatus of the invention.

Turning now to the drawings in detail, it will be seen that FIG. 1 illustrates in perspective a plug indicated generally at 10 which is of a generally rectangular configuration and has a housing formed of two generally similar halves 11 and 12, these housing halves being stamped and bent from sheet metal. At least the upper housing half is provided with a convex portion 13 leading to a side opening to receive armored cable containing the conductors to be connected to electrical components within the housing.

The housing has one open end in which are exposed the elements of a connector assembly contained therein. While various arrangements of the connector assembly are possible, the specific one illustrated includes a molded polymeric interior housing 15 having interior walls 16 and 17 which divide the interior housing to form three cavities 18, 19 and 20. Cavities 18 and 19 contain electrically conductive blades 20 and 21 and cavity 20 is vacant. It will also be observed that cavities 18 and 19 have specific shapes and interior ribs which act as keyways and permit the plug to be associated with a receptacle only in a specific, predetermined orientation. Thus, the receptacle with which it is used must be provided with mating portions.

The upper housing half 11 is also provided with upwardly protruding projections 23 and 24 which can further be used to define the proper orientation of the plug relative to its associated receptacle.

The width of interior housing 15 is somewhat less than that of the entire plug 10, leaving cavities 25 and 26 at the outer sides. These cavities are provided to receive portions of a latching mechanism, part of which is associated with plug 10 and is partly visible in FIG. 1. Housing portion 11 is provided with means defining an opening 28 and housing portion 12 is provided with an opening 29, these openings being formed in a position to receive latching members which are carried by the receptacle. Plug 10 also carries a release member including a manually operable portion 30 which is exposed through openings 31 and 32 in housing portions 11 and 12, respectively, these openings being aligned so that they define a single, generally rectangular, opening. Portion 30 is connected with a spring member which extends away from the open end of plug 10 in a curvilinear fashion, as will be further described in detail, and terminates in upwardly and downwardly extending tabs which engage openings in the housing portions. In FIG. 1, an opening 34 in housing portion 11 is visible, as is the tab 35 which extends into that opening. A similar tab and opening arrangement exists in housing portion 12 directly below opening 34. An additional spring member 37 is partly visible through opening 28 in FIG. 1, the end of that spring member being bent into a hook to firmly engage a recess 38 formed by notches in the upper and lower housing portions.

At the opposite side of the plug is a similar arrangement including a manually operable portion 40 which protrudes through an opening 41 in housing portion 11 and a similar opening 42 in housing portion 12. An opening 44 in housing portion 11 admits a tab 45 which is at the distal end of a curved spring member connected to manually operable portion 40. A further spring member 47 is hooked in a recess 48 adjacent the open end of the plug. Adjacent this release mechanism are openings 49 and 50 in housing portions 11 and 12, respectively, to receive latch members inserted into cavity 26. Again, the details of the release mechanisms and the associated latching mechanisms will be described further in greater detail.

Figure 2:
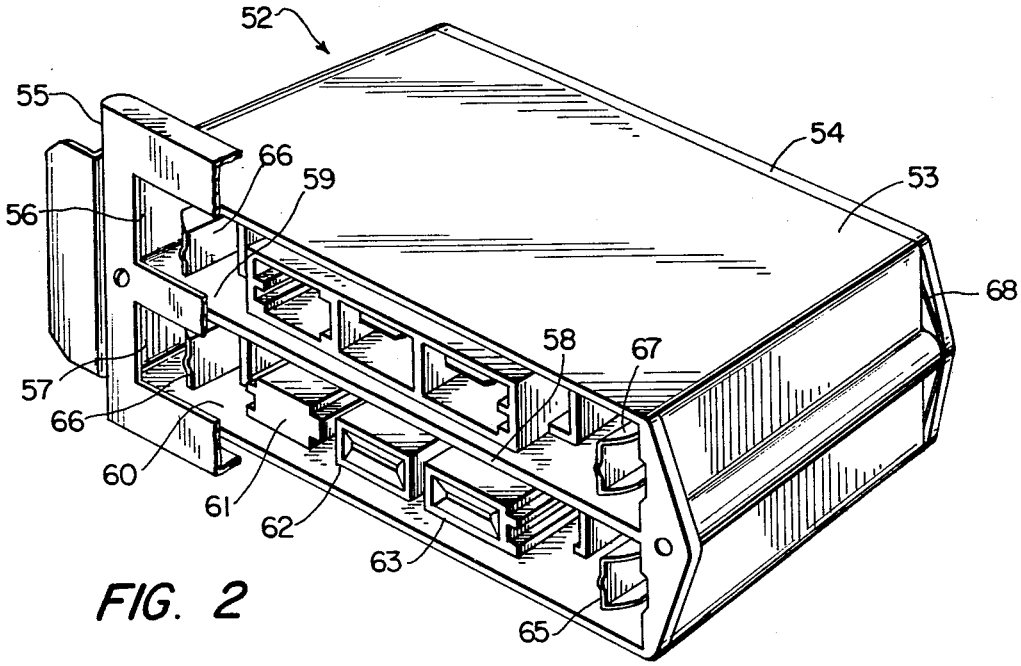
FIG. 2 is a perspective view, partially cut away, of a receptacle incorporating the apparatus of the invention.

Turning now to FIG. 2, that figure illustrates a suitable receptacle indicated generally at 52 for use in conjunction with plug 10. Receptacle 52 includes a housing 53 which is preferably formed of a polymeric material but which can also be metal. The back wall of the housing is closed by a cover plate 54, and the bottom wall of housing 53 is provided with openings along the rear edge thereof to permit the egress of wires for connection to electrical components within the housing. The housing 53 is generally rectangular in overall shape with mounting flanges at the end, and the front thereof can be provided with a cover and mounting plate 55, a sheet metal member only a portion of which is shown. This sheet metal member has elongated rectangular openings 56 and 57, each of which is dimensioned to receive a plug such as that illustrated in FIG. 10. As will be recognized, the appropriate edges of the rectangular openings in plate 55 can be provided with indentations to receive protrusions 23 and 24 for proper orientation of the plug relative to the receptacle.

Housing 53 is provided with a longitudinally extending wall 58 which divides the interior of the receptacle into two major cavities, 59 and 60. As will be recognized by comparison of the interiors of the plug and receptacle, cavity 60 is designed to cooperate with plug 10 in the specific embodiment illustrated. Thus, only that cavity will be discussed in detail. The interior of cavity 60 is provided with protrusions 61, 62 and 63 which are integrally formed with the molded exterior of housing 53 and which extend from a transverse interior wall near the rear portion thereof toward the open end of the housing. Each member 61, 62 and 63 is essentially a pillar, the exposed distal end of pillar 61 being closed and the ends of pillars 62 and 63 having a central slot and inclined guide surfaces leading to that slot for the purpose of receiving blades 20 and 21 of plug 10. It will be observed that the exterior surface of pillars 61 and 63 are shaped to mate with the interior shapes of cavities 20 and 18, respectively. Within pillars 62 and 63 are female contact members formed to make electrical contact with blades 20 and 21 when the plug is fully seated in the receptacle.

At the opposite ends of cavity 60 are latch members 65 and 66 which are provided with teeth to engage openings 28, 29, 49 and 50 in the housing of plug 10. Also in the upper cavity 59 are similar latch members 66 and 67, latch members 65 and 67 being formed as part of the same piece which is advantageously shaped from sheet metal, these latch members being unitarily formed with a mounting flange 68, a small portion of which extends between housing 53 and cover plate 54 at the rear of the housing.

The latching mechanism itself can be more clearly seen in FIG. 3 which shows a release mechanism indicated generally at 70 comprising a leaf spring one end of which is bent at 71 to form a U-shaped structure which extends from manually operable portion 30 to the end thereof which includes tab 35, discussed in connection with FIG. 1. The other end portion 37 of the leaf spring extends from the other end of the manually operable portion to the hook segment which engages the housing, as previously described.

The release mechanism is shown in the position it and the plug occupy when the plug is fully inserted into the receptacle. Latch member 65, as previously mentioned, is one-half of a dual latch member structure which is more fully illustrated in FIGS. 7 and 8, the other latch member 67 of this structure having been omitted from FIG. 3. Each latch member has a head portion which includes a pair of outwardly extending teeth 73 the front surface of which are inclined to permit the latch member to ride over the inwardly bent part of recess 38 at the open end of the case on either side of the hooked end of spring 37. Each tooth also forms a shoulder 74 which prevents the tooth from being disengaged once the tooth has entered opening 28, for example, as depicted in FIG. 3.

Figure 7:
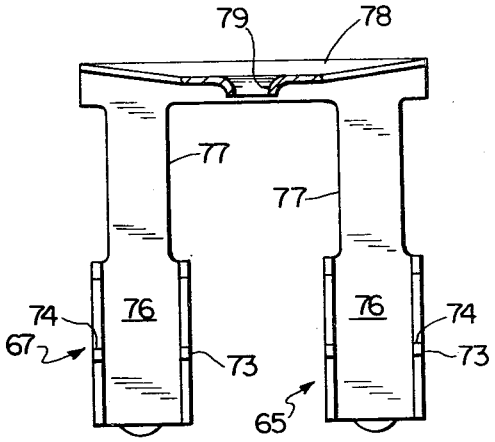
FIG. 7 is a side elevation of a dual latch member portion of the latch mechanism of FIG. 3 along line 7—7 of FIG. 8.
Figure 8:
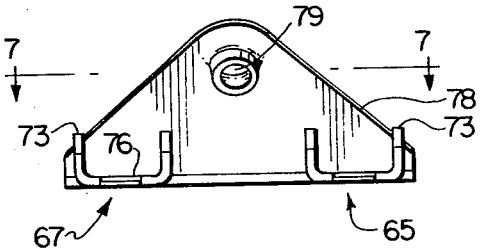
FIG. 8 is an end elevation of the latch member of FIG. 7.

Each latch member head is formed in a U-shape with a tooth on each side and a lateral surface 76 extending between and perpendicular to the two teeth. A spring arm 77 is formed as an extension of the material forming surface 76 and joins an L-shaped mounting bracket portion 78 which has therein a mounting hole 79. As shown in FIGS. 3 and 7, the bracket portion is initially formed so that the angle between the spring arms and the mounting portion is slightly less than 90° so that when the structure is mounted in a receptacle housing 52 a bias is present which tends to force the tooth of each latch member outwardly relative to housing 52.

Figure 3:
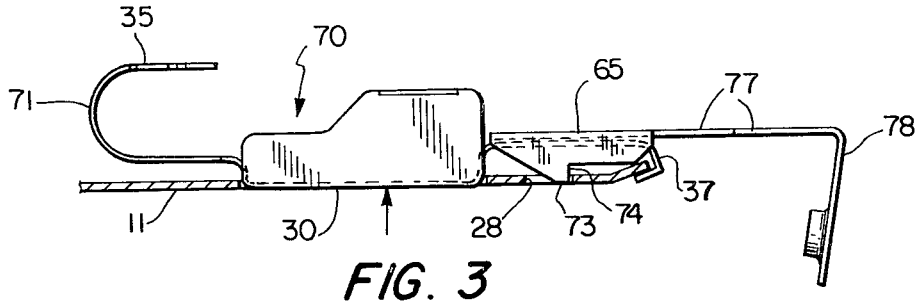
FIG. 3 is a top plan view of one embodiment of a latch mechanism in accordance with the invention with a portion of one housing.

As will be seen from FIG. 3, when the plug and receptacle are coupled together, the forward inclined surface of each tooth rides inwardly (or upwardly as shown in the figure ) flexing the spring arms 77 so that the tooth can proceed inwardly to openings such as 28. Once in that position, the latch head remains in the position shown in FIG. 3.

In order to disengage the housings, release portion 30 is manually depressed inwardly in the direction of the arrow, flexing the leaf spring portion 71 and causing portion 37 to bow inwardly, pressing against surface 76 and extracting teeth 73 from openings 28 and 29. The plug housing can then be extracted from the receptacle.

Figure 4:
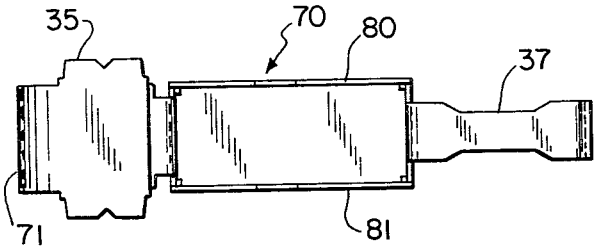
FIGS. 4 and 5 are front and back elevations of one of the release member portions of the latch mechanism of FIG. 3.
Figure 5:
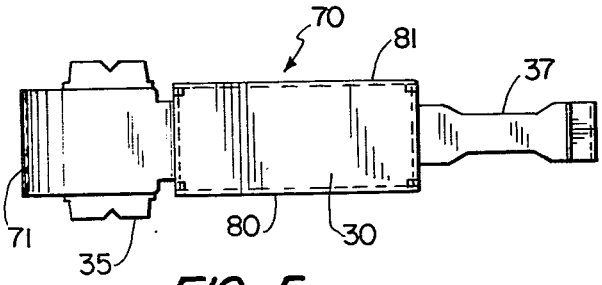
Figure 6:
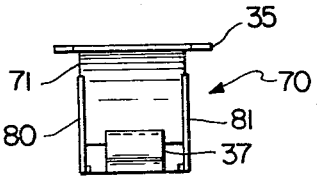
FIG. 6 is an end elevation of the release members of FIGS. 4 and 5.

As seen in FIGS. 4–6, the release mechanism is formed from a single piece of sheet metal which is cut to shape tabs 35, spring arms 71 and 37, and the manually operable portion. The sides 80 and 81 adjacent the manually operable portion are bent upwardly so as to be parallel with each other and perpendicular to the surface which is manually depressed, thereby rendering the portion 30 substantially inflexible but leaving portions 71 and 37 flexible. Those portions are shaped to form the hook at the end of portion 37 and the arcuate bend of portion 71.

Figure 9:
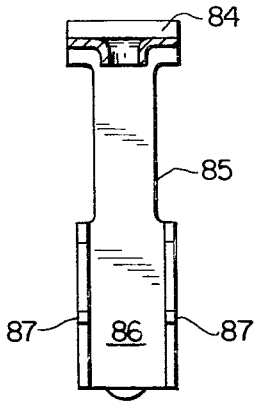
FIGS. 9 and 10 are side and end elevations, respectively, of a single latch member usable in a mechanism of the type shown in FIG. 3, FIG. 9 being taken along line 9—9 of FIG. 10.
Figure 10:
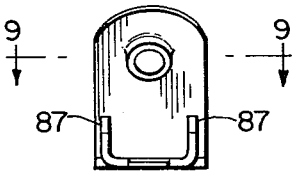

FIGS. 9 and 10 illustrate side and end elevations, respectively, of a single latch element which, as will be seen, is identical in plan view to the element shown in FIG. 3. The L-shaped bracket portion 84 is connected to a spring arm 85 which is formed as an extension to a surface 86 against which the release mechanism can operate. Tooth portions extend perpendicularly from opposite sides of surface 86, terminating in teeth 87. This can be used in a receptacle structure having a cavity to receive only one plug.

Figure 11:
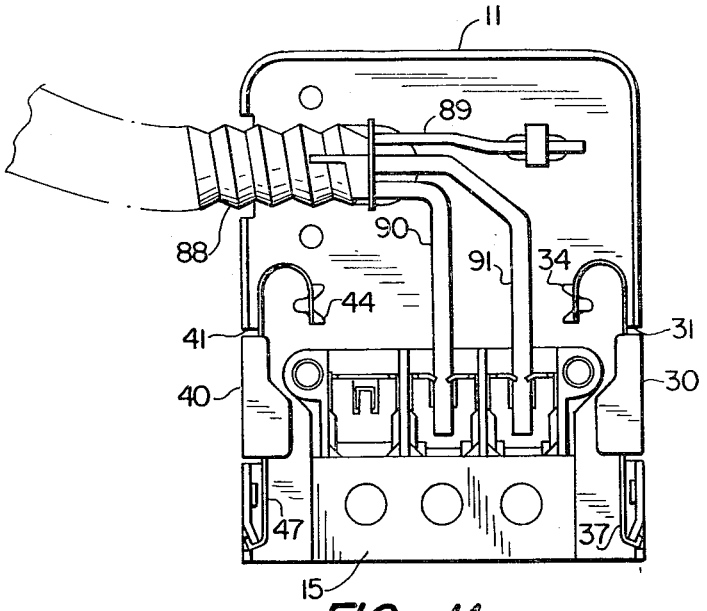
FIG. 11 is a top plan view of the plug portion of FIG. 1 with the top housing portion removed to show the interior components.

FIG. 11 shows a bottom plan view of the plug of FIG. 1 with housing portion 12 removed. As seen therein, an armored cable 88 extends into the opening formed by recess 13 and provision is made for connecting the ground wire 89 from the cable to the housing portion itself. Current-carrying conductors 90 and 91 are connected to the electrical portions of the connector within housing 15. The relationship of the release mechanisms can be more clearly seen in this figure, the components thereof being identified as in FIGS. 1 and 3–8.

Figure 12:
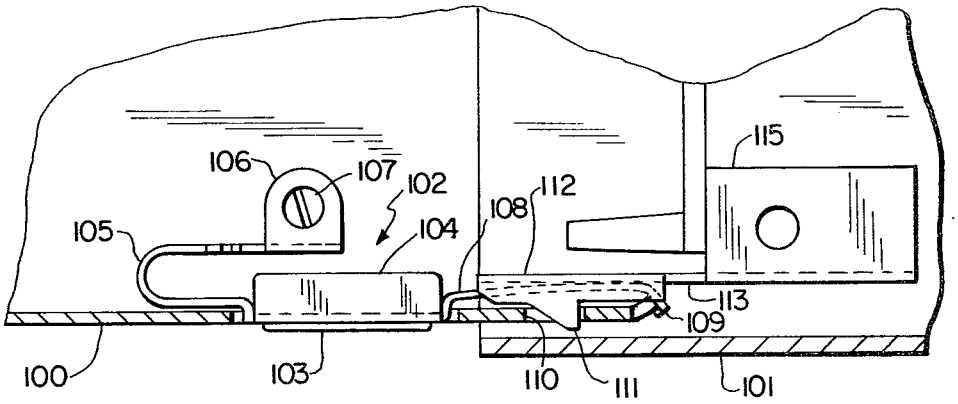
FIG. 12 is a top plan partial section view of a second embodiment of a latch mechanism in accordance with the invention along line 12—12 of FIG. 13.
Figure 13:
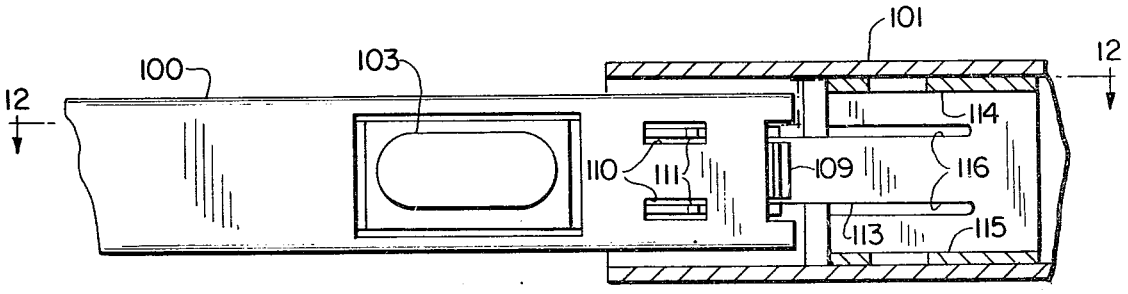
FIG. 13 is a side elevation, in partial section, of the latch mechanism of FIG. 12.

FIGS. 12 and 13 show a further embodiment of a latch structure and release mechanism in housings 100 and 101 which are to be coupled together, the housings being similar to those illustrated in FIGS. 1 and 2. The release mechanism indicated generally at 102 includes a spring member which is quite similar to that discussed in connection with FIGS. 3–6 having a central portion 103 with bent-upsides 104 to render that portion substantially inflexible, a U-shaped spring portion 105 which is connected to housing 100 by a tab 106 having an opening therein to receive a screw 107 which is threaded into the housing.

At the other side of portion 103, the spring continues into a slightly curved relatively stiff portion 108, terminating at a free distal end 109 which is not connected to the housing. Housing 100 includes openings 110 to receive the teeth 111 of a latch member head 112, the latch member head being formed as described in connection with FIGS. 3, 7 and 8. The latch member is generally U-shaped in cross section, and the central portion thereof continues into a spring arm 113 which terminates in a mounting structure having inwardly extending side plates 114 and 115.

As best seen in FIG. 13, spring arm 113 is formed in part by elongated openings 116 formed in the support member. Side plates 114 and 115 are connected to housing 101 as by screws or rivets.

The operation of the embodiment of FIGS. 12 and 13 is substantially the same as that discussed in connection with the previous embodiment, except that portion 108 need not bow to the same extent as in the previous embodiment.

As will be recognized, the contact between latch member 65 and the housing and release mechanism portion precedes the interconnection of the electrical contacts including, for example, blades 20 and 21 with the female receptacle portions in pillars 62 and 63. Additionally, when disengaging couplings, the ground connection is the last to be broken.

While certain advantageous embodiments have been choosen to illustrate the invention it will be understood by those skilled in the art that various changes and modifications can be made therein without departing from the scope of the invention as defined in the appended claims.

What is claimed is:

1. A latching apparatus for an electrical connector assembly of the type including first and second telescopically joinable housings, each housing having an open end and containing electrically conductive members exposed to the open end thereof for making contact when the housings are joined in a predetermined relative orientation, and each housing carrying a portion of the latching apparatus which comprises a latch member having
- a tooth,
- means defining a lateral surface attached to and extending perpendicular to said tooth near the inner limit thereof, and
- a spring arm connected at one end to said means defining said surface and at the other end to a first one of said housings;

means on said second one of said housings for receiving said tooth when said housings are joined, said tooth being urged therein by said spring arm;

a manually operable release mechanism on said second one of said housings comprising
- a leaf spring within said second one of said housings and adjacent said means for receiving, at least one end of said leaf spring being fixedly attached to said second housing,
- said leaf spring being positioned to extend in generally parallel relationship with said surface when said housings are joined; and means for providing access to said leaf spring to permit manual movement of said spring against said surface for disengaging said tooth from said means for receiving to permit separation of said housings.

2. An apparatus according to claim 1 wherein both ends of said leaf spring are fixedly attached to said second housing.

3. A latching apparatus for an electrical connector assembly of the type including first and second telescopically joinable housings, each housing having an open end and containing electrically conductive members exposed to the open end thereof for making contact when the housings are joined in a predetermined relative orientation, and each housing carrying a portion of the latching apparatus which comprises a latch member having first and second outwardly extending teeth in parallel spaced relationship with each other, means defining a lateral surface extending between and perpendicular to said teeth near the inner limit thereof forming a U-shaped member, and a spring arm connected to one end to said means defining said surface and at the other end to a first one of said housings;

means in a wall of the second one of said housings defining first and second openings positioned to receive said first and second teeth, respectively, when said housings are joined, said teeth being urged into said openings by said spring arm;

a manually operable release mechanism on said second one of said housings comprising a leaf spring extending parallel with said wall and adjacent said openings, at least one end of said leaf spring being fixedly attached to said second housing, said leaf spring being positioned to extend in generally parallel relationship with said surface and between said teeth when said housings are joined; and means defining an access opening in said wall through which said leaf spring can be manually urged away from said wall to engage and move said surface, thereby disengaging said teeth from said openings to permit separation of said housings.

4. An apparatus according to claim 3 wherein said latch member is totally recessed within the open end of said first housing, and said release mechanism and leaf spring are recessed inwardly of the open end of said first housing.

* * * * *